United States Patent [19]

Stegmüller

[11] Patent Number: 4,814,559

[45] Date of Patent: Mar. 21, 1989

[54] ELECTRICAL SWITCHING DEVICE FOR HIGH SWITCHING VOLTAGES

[75] Inventor: Karl Stegmüller, Wiesent, Fed. Rep. of Germany

[73] Assignee: Sachsenwerk Aktiengesellschaft, Regensburg, Fed. Rep. of Germany

[21] Appl. No.: 33,941

[22] Filed: Apr. 3, 1987

[30] Foreign Application Priority Data

Apr. 3, 1986 [DE] Fed. Rep. of Germany ..... 3611270

[51] Int. Cl.[4] ..... H01H 33/14; H01H 9/40

[52] U.S. Cl. ..... 200/145; 200/144 B; 200/148 R

[58] Field of Search ..... 200/145, 148 R, 144 B

[56] References Cited

U.S. PATENT DOCUMENTS

| | | | |
|---|---|---|---|
| 3,390,305 | 6/1968 | Greenwood | 200/144 B |
| 3,660,723 | 5/1972 | Lutz et al. | 200/144 AP |
| 3,777,179 | 12/1973 | Lutz | 307/136 |
| 3,982,088 | 9/1976 | Porter | 200/144 B |
| 4,087,664 | 5/1978 | Weston | 200/145 |
| 4,204,101 | 5/1980 | Dethlefsen | 200/144 B |
| 4,514,606 | 4/1985 | Veverka | 200/148 R |

FOREIGN PATENT DOCUMENTS

| | | | |
|---|---|---|---|
| 1064134 | 8/1959 | Fed. Rep. of Germany | 200/145 |
| 1236052 | 3/1967 | Fed. Rep. of Germany | 200/145 |
| 2103428 | 8/1972 | Fed. Rep. of Germany | 200/145 |
| 2350584 | 4/1974 | Fed. Rep. of Germany . | |
| 2934776 | 3/1981 | Fed. Rep. of Germany . | |
| 3131271 | 8/1982 | Fed. Rep. of Germany | 200/145 |
| 3218907 | 11/1983 | Fed. Rep. of Germany . | |
| 1156919 | 7/1969 | United Kingdom . | |

OTHER PUBLICATIONS

Ein-und Ausschalten von Hochspannungs-kondensatoren mit Druckluftschaltern. BBC Nachrichten, Oct.-/Nov. 1956, pp. 128-135.

Bottger, C. and Schemmann, B., Schaltanlagen für Ortsnetzverteilerstationen mit Vakuum-Leistungsschalter., etz, vol. 106, No. 10 (1985) pp. 504-507.

Gasisolierte Mittelspannungs-Lasttrenn-schalteranlagen für Transformatorstationen. Brown Boveri Technik, Dec. 1985, pp. 586-591.

*Primary Examiner*—Robert S. Macon

*Attorney, Agent, or Firm*—Spencer & Frank

[57] ABSTRACT

An electrical switching device for switching high voltages in a network having a defined rated voltage. The device includes a series connection of at least first and second current interrupters having control elements across which a load voltage is distributed. Each interrupter operates according to different quenching principles and exhibits different dielectric behavior immediately after a zero passage of load current to be interrupted. The first interrupter comprises a first switch which has an operating voltage that is low relative to a mains voltage of the network and includes means for interrupting, at relatively low switching voltages without participation of the second interrupter, currents having inductive components. The second interrupter comprises a second switch having switching contacts and delay means for opening such switching contacts with a time delay of several milliseconds after the first interrupter is opened for interrupting load currents that are small relative to currents interrupted by the first interrupter. The series connection of the interrupters interrupts capacitive currents also under grounding conditions with comparatively large recovery voltages and without restriking, with a distribution of voltage across the interrupters, when both are open, being controlled solely by their own ground capacitances.

18 Claims, 8 Drawing Sheets

SWITCH POSITION

SWITCH POSITION

SWITCH POSITION

SWITCH POSITION

SWITCH POSITION

SWITCH POSITION

SWITCH POSITION

SWITCH POSITION

ELECTRICAL SWITCHING DEVICE FOR HIGH SWITCHING VOLTAGES

BACKGROUND OF THE INVENTION

The present invention relates to an electrical switching device for switching high voltages in a network having a defined rated voltage, the device including a series connection of at least first and second current interrupters having control elements across which a load voltage is distributed, each interrupter operating according to different quenching principles and exhibiting a different dielectric behavior immediately after a zero passage of load current to be interrupted, the first interrupter exhibiting a steep rate of rise in its dielectric strength with a maximum dielectric strength value which is a fraction of the defined rated voltage, and the second interrupter having a relatively flat rate of rise in dielectric strength compared to the first interrupter with a maximum dielectric strength value which lies above the maximum dielectric strength value of the first interrupter.

Such switches are known in the art as interrupters for direct current circuits. For example, German Offenlegungsschrift [laid-open patent application] No. 2,350,584 discloses a direct current power switching device operating with voltage dividers in which a first power switch, which may be a vacuum switch, is connected in series with a parallel connection of a second power switch, which may be an SF6 gas insulated switch, and an electronic switch. The prior art switching device permits current interruptions which are essentially controlled by the current/voltage characteristic of the electronic switch in conjunction with capacitors connected in parallel with the switches upon the occurrence of a recovery voltage which is greater than the dielectric strength of each one of the two power swithces.

German Offenlegungsschrift No. 3,131,271, discloses a switching system of the interruption of a high voltage direct current comprising a series connection of a vacuum switch and a gas jet switch which are voltage controlled by being connected in parallel with a voltage dependent resistor or capacitor, respectively. This solution utilizes, on the one hand, the capability of vacuum switches to interrupt currents when there is a steep rise in the current and in the recovery voltage and, on the other hand, the capability of the high dielectric strength of an SF6 switch in the low frequency range of the recovery voltage. The two switches open simultaneously and the capacitor connected in parallel with the SF6 switch causes a delayed rise of the recovery voltage across the SF6 switch.

The known switching devices have a relatively complicated configuration because they employ further switching devices and control elements in addition to the two power switches. Moreover, both power switches operate in synchronism and are charged with the same length arc times.

Additionally, German Offenlegungsschrift No. 2,934,776 discloses a medium voltage load break switch composed of a vacuum switching tube and an air break switch. The vacuum switching tube in this case is designed so that it is able to handle recovery voltages occurring during the interruption of operating currents having inductive and capacitive current components, while the air break switch is opened without curent and its separated path merely takes care of the high dielectric stress.

SUMMARY OF THE INVENTION

It is an object of the present invention to provide a particularly economical switching device which does not require much space and has a long service life, and in which the current important in network operation primarily for a load switching system can be reliably interrupted even if the recovery voltage is high compared to the mains voltage.

Moreover, it is another object of the invention to provide a novel switching device which is able to switch off all fault currents in a network having low short-circuit power.

It is yet a further object of the invention to provide a switching device which is particularly suitable for installation in a completely encapsulated, gas or liquid insulated switching system.

The above and other objects are accomplished in the context of an electrical switching device as first described above, wherein: the first interrupter comprises a first switch which has an operating voltage that is low relative to a mains voltage of the network and which includes means for interrupting, at relatively low switching voltages without participation of the second interrupter, currents having inductive components; and the second interrupter comprises a second switch having switching contacts, and delay means for opening the switching contacts with a time delay of several milliseconds after the first interrupter is opened for interrupting load currents that are small relative to currents interrupted by the first interrupter; wherein the series connection of the interrupters also interrupts capacitive currents under grounding conditions with comparatively large recovery voltages and without restriking, with a distribution of voltage across the interrupters, when both are open, being controlled solely by their own and ground capacitances.

The novel concept of the invention can be realized particularly effectively for multipurpose load switches.

Other objects and advantages of the invention will become apparent from the following detailed description of an embodiment of the invention when considered in conjunction with the accompanying drawings.

DESCRIPTION OF THE PREFERRED EMBODIMENT

Figure 1:
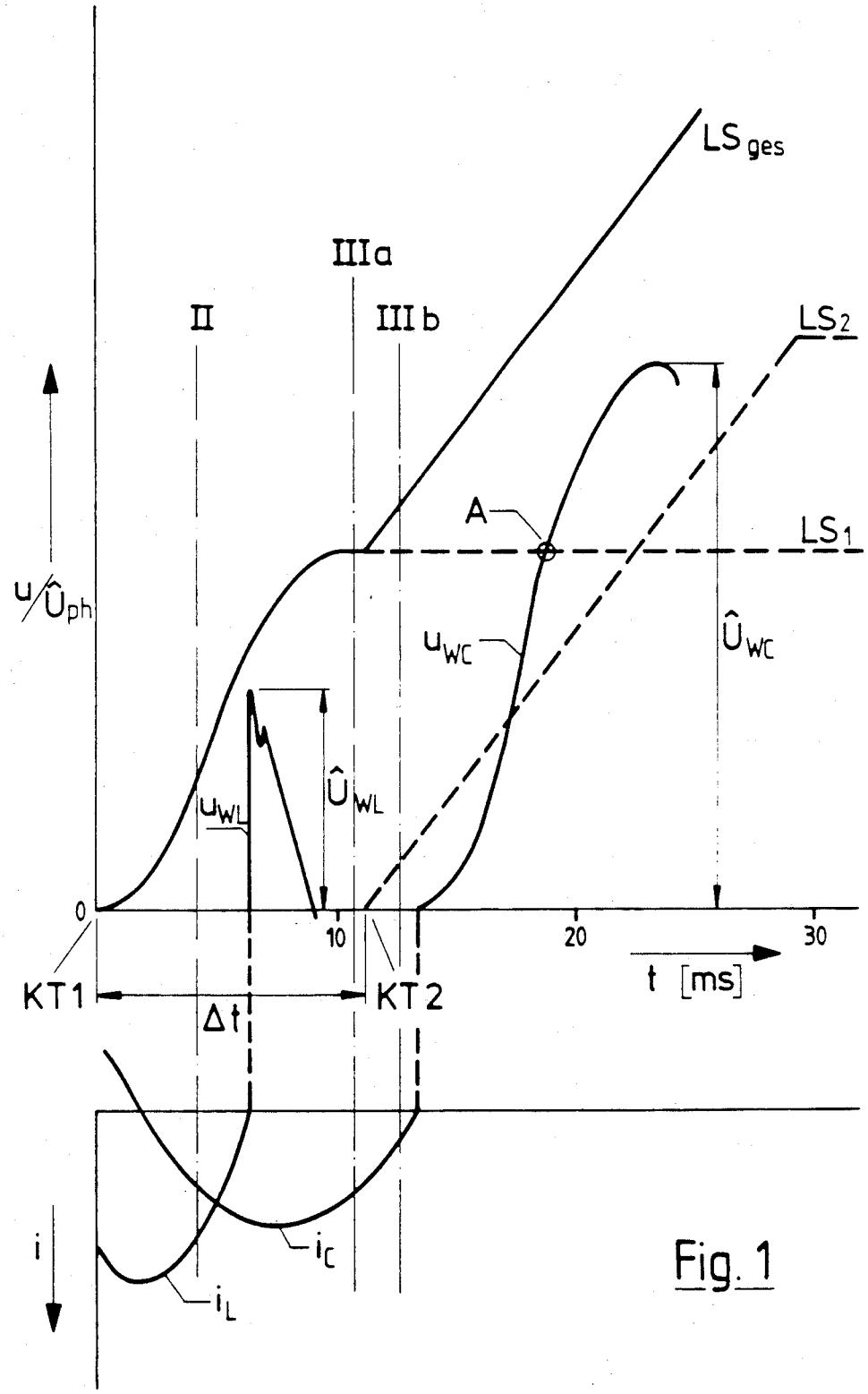
FIG. 1 is a signal diagram which shows the load characteristic over time of a switching device according to the invention for various switching voltages.
Figure 2A:
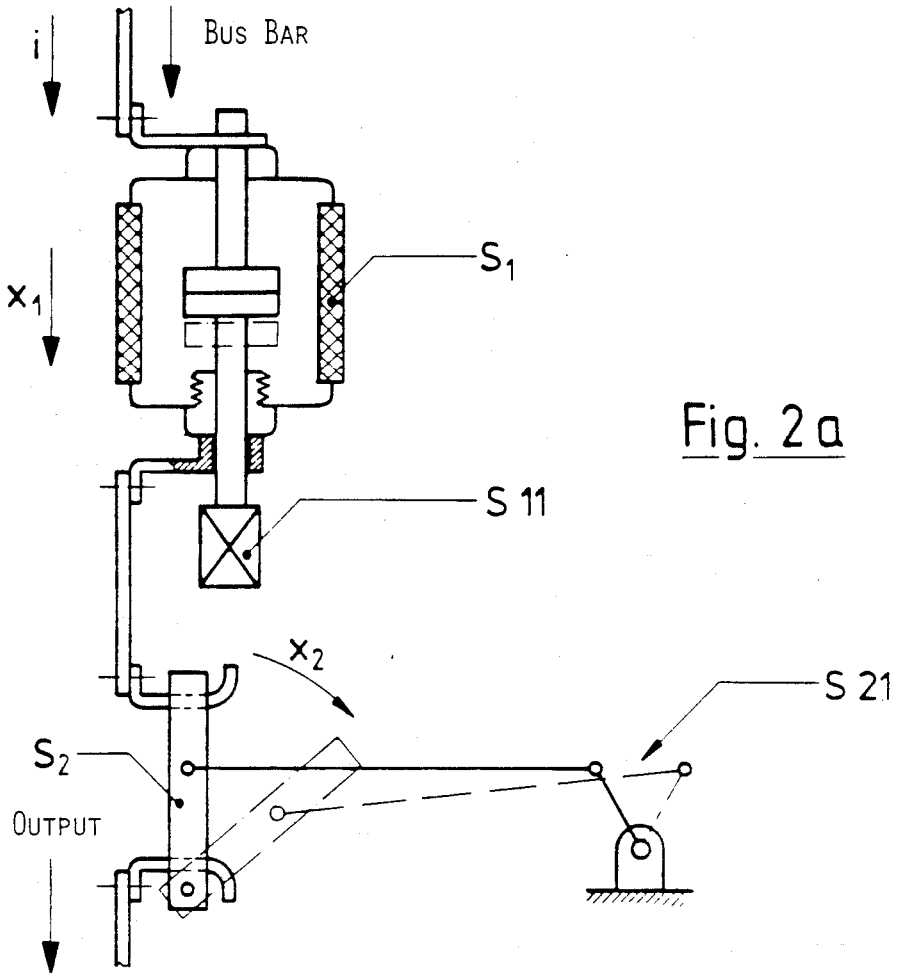
FIG. 2*a* is a schematic which shows an embodiment of the switching device according to the invention.

FIG. 1 is a signal diagram showing the basic considerations of the present invention involving series connected switches as illustrated, for example, in FIG. 2*a*.

The time curve of the load characteristic (dielectric strength) $LS_1$ beginning at the moment of contact separation KT1 of a switch S1 (FIG. 2) is distinguished by a steep rate of rise within the first milliseconds, with a maximum value being reached after about 10 ms, such maximum value being, for example, approximately twice the peak value of the phase voltage $V_{ph}$ of a load switching system.

The contact separation time KT2 of switch S2 occurs later by an interval Δt; the associated load characteristic $LS_2$ of switch S2 begins at time KT2 and ascends linearly with a comparatively low steepness to an end value which is noticeably greater than the end value of load characteristic $LS_1$. The maximum value of load characteristic $LS_1$ is again noticeably higher than the switching voltage $U_{WL}$ occurring during the interruption of load currents $i_L$ having inductive components in the first interrupted phase of a three-phase system, as can also be seen in FIG. 1. Such load currents are thus interrupted solely by switch S1. Advantageously, conventional and economic vacuum load switches for low rated voltages can be employed for this purpose. For example, known vacuum load switches having a rated voltage of 7.2 kV or 12 kV are suitable for use in networks having a rated voltage of 24 kV.

If a capacitive current $i_c$ is to be interrupted, the recovery voltage $u_{WC}$ oscillates in the first quenched phase at less steepness but to a significantly greater height and would result, at point A where it intersects with load characteristic $LS_1$, in a reignition of the arc and thus return triggering of the switch. Due to the series connection of switch S1 with switch S2 which opens later with a delay of Δt, it is possible to produce a load characteristic $LS_{ges}$ of the series connected switches which permits reliable interruption of capacitive currents. According to the invention, Δt is set at an order of magnitude corresponding to the average arc duration which occurs across switch S1 during the interruption of inductive currents and has a value of several milliseconds.

For a better understanding of the switching voltages occurring in capacitive circuits, reference is made to the article, entitled "Ein-und Ausschalten von Hochspannungskondensatoren mit Druckluftschaltern" [Swtiching On and Off High Voltage Capacitors Equipped With Compressed Air Circuit Breakers], *BBC Nachrichten* [News From Brown Bovery Crop.], October/November, 1956, pages 128–135. This paper indicates that is capacitor batteries are interrupted, peak values occur in the mains frequency switching voltage $\hat{U}_W$ which, compared to the peak value of the phase voltage $\hat{U}_{ph}$ in the first quenched phase, have an amplitude factor $\hat{U}_W/\hat{U}_{ph}$ of 2.5 and, if one phase is grounded, even of 3.6.

Conventional switching devices for the above-described switching tasks must be able to withstand switching voltages which, in medium voltage networks, lie in an order of magnitude of the standard alternating test voltage. For vacuum power switches this requires the use of relatively large switching chambers which are expensive.

Figure 2B:
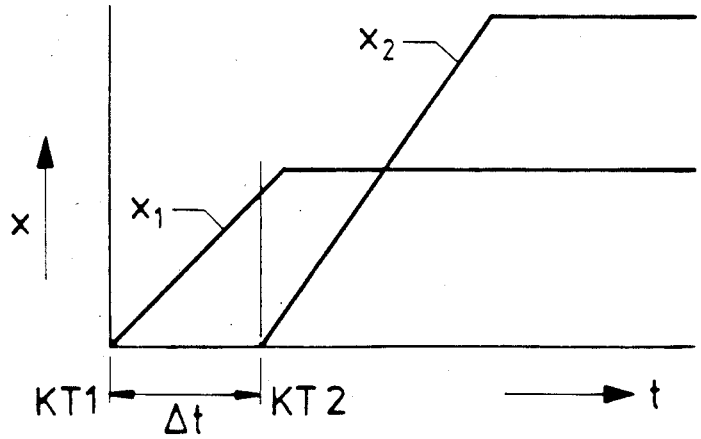
FIG. 2*b* is a diagram illustrating the motion sequences of the device in FIG. 2*a*.

FIG. 2*a* shows an embodiment of a switching device according to the invention in single-phase illustration. FIG. 2*b* shows the movements over time of the two switches S1 and S2 where $x_1$ is the contact path of switch 1 and $x_2$ is the contact path of switch 2. A small vacuum load switch which has a dielectric strength that is low compared to the operating voltage of the system is provided as switch S1 and is controlled by a drive S11. Switch S2 can be provided in the form of a simply configured, conventional load switch which operates with a high quality insulating medium, such as SF6, $N_2$ or insulating oil. It is actuated by way of a crank drive S21 and a drive (not shown). Since switch S2, according to the invention, opens with a time delay of Δt, weak inductive currents do not influence it, or if they do, only in the phase to be extinguished last. If capacitive currents are to be interrupted, the effective arc time, as shown in FIG. 1, in the phase to be quenched first lies only in the descending portion of current $i_c$. In many cases, switch S2 will therefore not require an actual quenching device. To be able to assure, however, the longest possible maintenance intervals for the entire switching device, it is recommended to equip the switching contacts of switch S2 with contact pieces 21 and 22 of a material that does not burn off. Switch S2 simultaneously performs the function of a disconnecting switch.

Insulating oil is a liquid having a high dielectric value and whose characteristics are defined, for example in IEC Publication 296 (International Electrotechnical Commission) for use in transformers and switching systems.

According to an additional feature of the invention, the insulating medium of switch S2 may simultaneously also be used to increase the external insulation strength of switch S1. This makes it possible to use standard vacuum switches having a relatively low rated voltage for switch S1. Since the arc load in switch S2 is only very low due to the contact opening with a delay of Δt, no noticeable reduction of the insulating capability of the switching device occurs even after many switching processes.

The drives for switches S1 and S2 are synchronized by way of mechanical or electrical means so that the contacts open at times which differ by the interval Δt.

Figure 6:
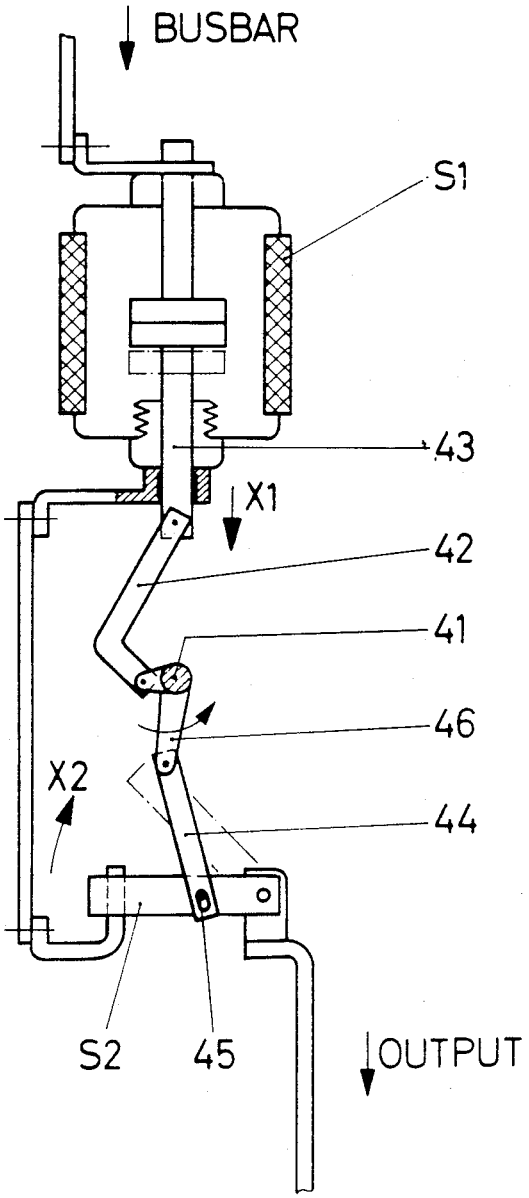
FIG. 6 is a schematic illustration of an embodiment of a drive arrangement for switches S1 and S2 to produce a delay $\Delta t$ by mechanical means.

With reference to FIG. 6, the bolt 43 of the movable contact of switch S1 is connected, by way of a switch rod 42, with the drive shaft 41 of an energy source (not shown). If shaft 41 rotates in the direction of the arrow, the contacts of switch S1 open. At the same time, a crank 46, likewise fastened to shaft 41, pivots along and transfers the rotary movement via switch rod 44 to switch S2. During the first part of the rotary movement and due to the selected starting position of crank 46, switch S2 does not move in the opening direction. (Dead point position). The desired delay Δt can be realized with precision by suitably dimensioning the long hole 45 of switching rod 44.

Figure 7:
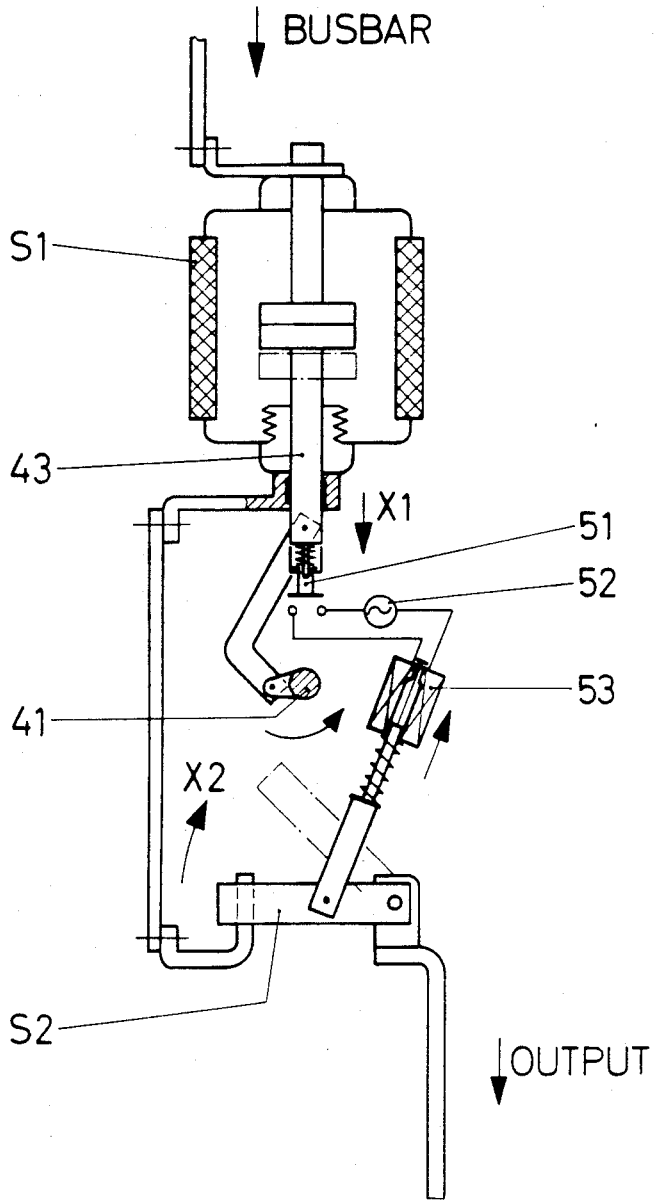
FIG. 7 is a schematic illustration of another embodiment of a drive arrangement for switches S1 and S2 to produce a delay Δt by electrical means.

In FIG. 7, switch S1 is again actuated by drive shaft 41. A resilient auxiliary contact 51 is disposed at contact bolt 43 of the movable contact and closes after part of switching path $X_1$, thus connecting energy source 52 with a magnetic drive 53. This magnetic drive 53 opens switch S2 with a delay. The moment at which auxiliary contact 51 is closed, in connection with the electromagnetic time constant of magnetic drive 53 determines the delay Δt.

To further clarify the operation of the switching device according to the invention, FIGS. 3 and 4 each show the switching sequence for a partially inductive load current $i_L$ and a partially capacitive current $i_c$, respectively, with switches S1 and S2 in the positions characteristic for interruption.

Figure 3A:
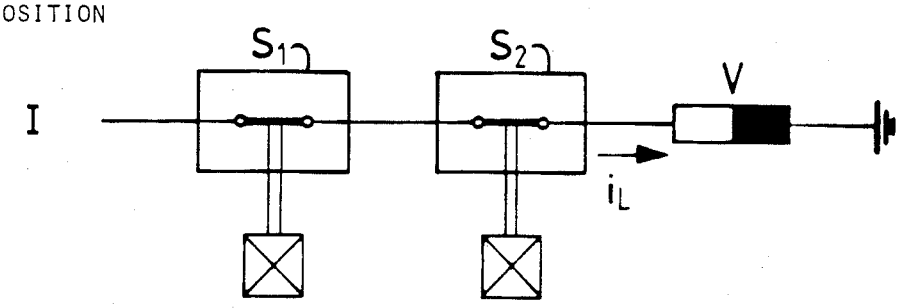
FIGS. 3*a* to 3*d* are schematics showing the switching sequence of a switching device according to the invention for interruption of a partially inductive load current.
Figure 4A:
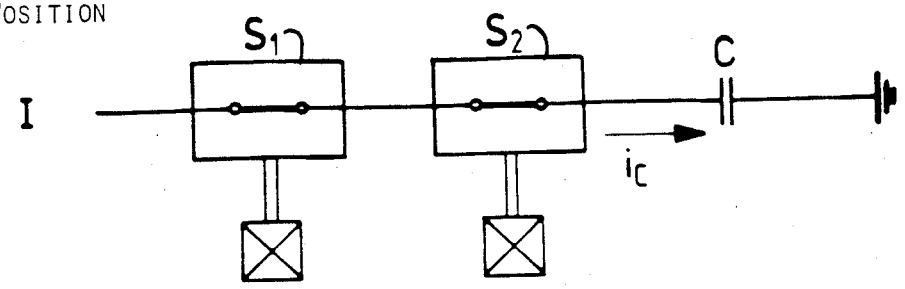
FIGS. 4*a* to 4*d* are schematics showing the switching sequence of a switching device according to the invention for interruption of a capacitive current.

In switch position I of FIG. 3*a* and 4*a*, both switches are closed, the operating current flows through switches S1 and S2 to load V or to capacitor C.

Figure 3B:
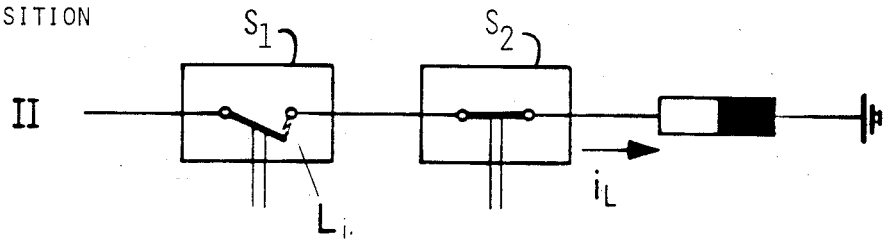
Figure 4B:
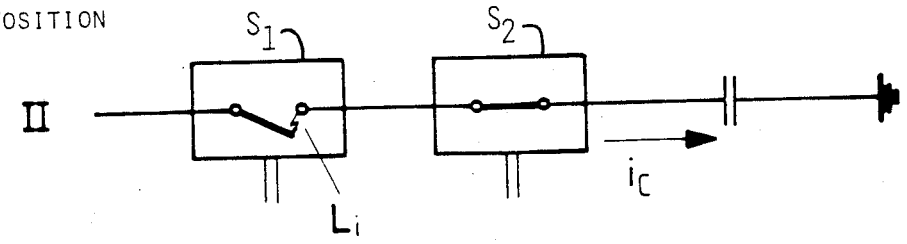

In switch position II of FIGS. 3*b* and 4b, switch S1 is open, while switch S2 is still closed, and an arc Li burns at the electrodes of switch S1 (see FIG. 1).

Figure 3C:
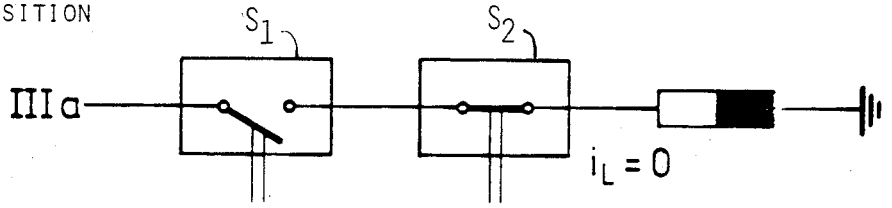
Figure 3D:
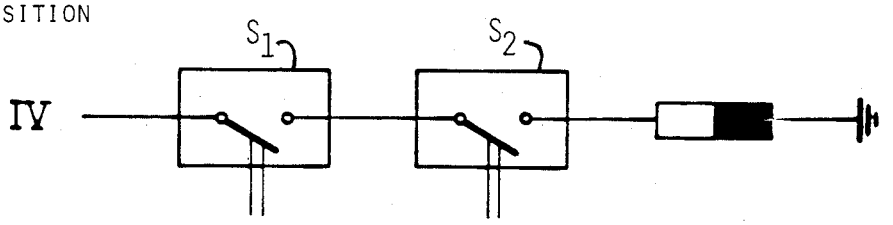

In FIG. 3*c*, the arc is extinct in switch position IIIa and $i_L=0$. Switch S1 is now almost completely open and is able to handle the switching voltage $\hat{U}_{WL}$. The interruption process is completeed although switch S2 is still closed. At the end of the switch movement onto switch position IV of FIGS. 3*d* and 4*d*, both switches are open.

Figure 4C:
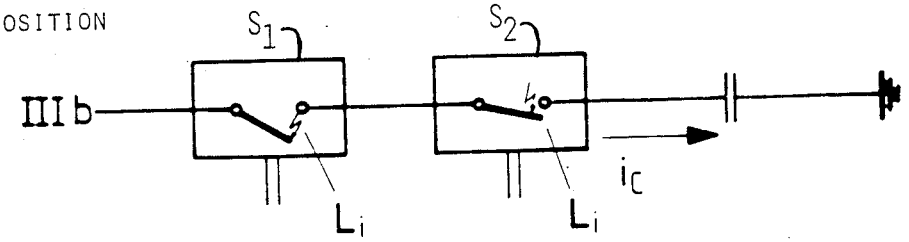
Figure 4D:
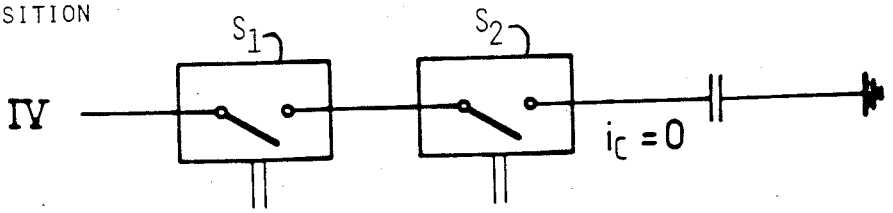

In FIG. 4*c*, switch position IIIb occurs shortly after contact separation KT2 of switch S2, the current $i_c$ not yet having been interrupted by switch S1. Therefore, arcs Li burn in both switches. After the next zero passage, $i_c$ is interrupted, and the series connected switches S1 and S2 resist the peak value $\hat{U}_{WC}$ of the capacitive switching voltage.

The concept of the invention of a stepped interruption of different load types, i.e. inductive and capacitive, can also be used similarly for other associations of switching voltages and load characteristics. For example, it may be of advantage in some cases to set the upper limit of characteristic $LS_1$ to a value which is greater than $2.5.\hat{U}_{ph}$, while after the separation of the contacts of switch S2, ground producing faults are additionally interrupted by means of even greater switching voltages. With the appropriate determination of the voltage values, the switching device according to the invention can also be used to advantage for one or two phase networks.

Figure 5:
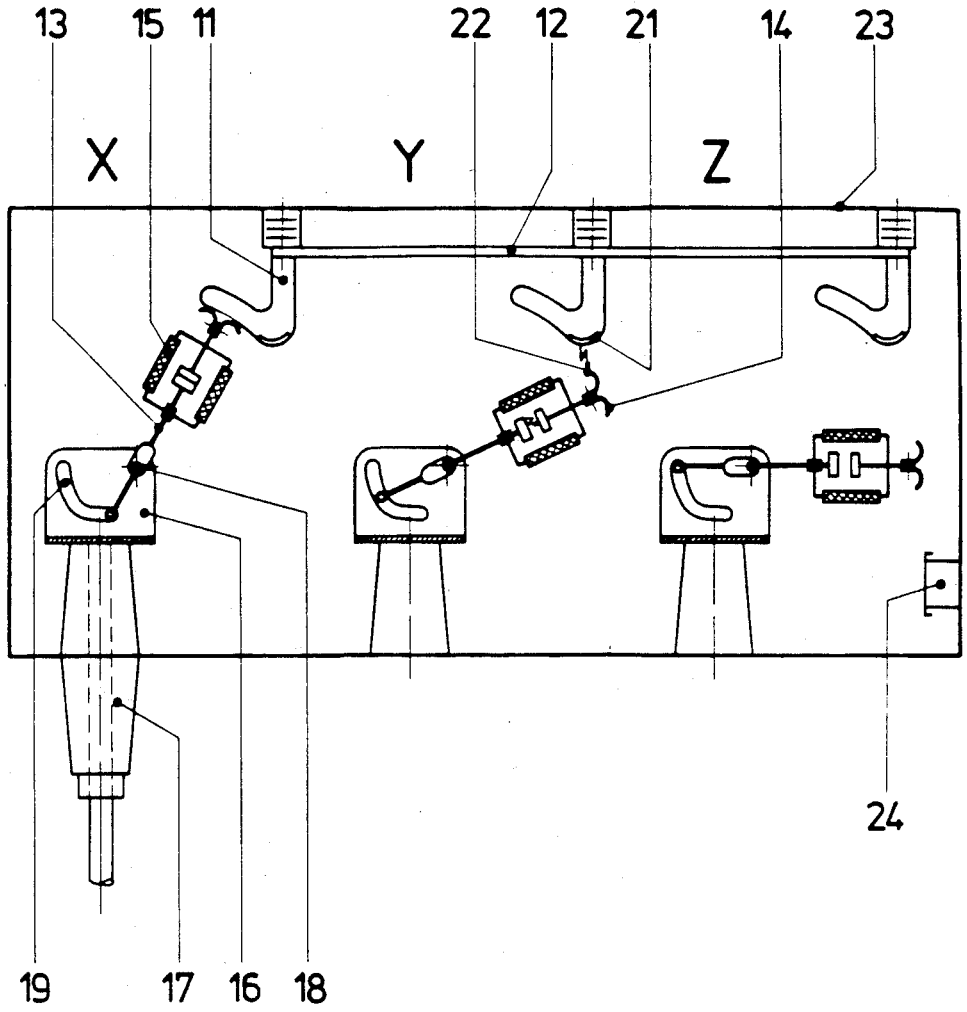
FIG. 5 is a schematic showing an intergrated embodiment of switches S1 and S2 in a closed encapsulation according to a further aspect of the invention.

To be able to equip particularly small volume switching systems with the advantages of the present invention, switches S1 and S2 can be structurally combined in a common switching device having a common drive. FIG. 5 shows a three-field load switching system including switches X, Y and Z, with switch S1 being integrated as a vacuum switch in switch S2 which is equipped with a pivot arm 13. With reference to FIGS. 1 and 4*a*, FIG. 5 shows schematically a switch X in the ON position I in a switching device including a stationary contact 11 in communication with a bus bar 12, pivot arm 13 and its contact piece 14, vacuum load switch 15 disposed in pivot arm 13, as well as a terminal 16 at the fulcrum, which connects the switch with a passage 17 of the socket of a high voltage plug-in connector. Fulcrum terminal 16 here supports the fulcrum 18 of pivot arm 13 and a rocker 19 which controls the opening movement of vacuum switch 15 so that it occurs essentially before the galvanic separation of pivot arm 13 from stationary contact 11.

For the center switch Y, the switching device is in a position which corresponds to position IIIb of FIG. 4*c* shortly before interruption of a capacitive current. Stationary contact 11 and pivot arm 13 may be reinforced by contact members 21 and 22 made of a non-combustible contact material. Switch Z is shown in the open position of the switching device (position IV in FIG. 4*d*).

The above-described switching device is preferably used with at least three-pole switching units in a completely encapsulated, gas or liquid insulated switching system, with FIG. 5 also showing the surrounding encapsulation 23 as well as a moisture absorber 24 which is recommended for SF6 insulated systems.

The moisture absorber employed may be, for example Baylith W 894 manufactured by Bayer Ag, Leverkusen, Federal Republic of Germany. This substance is constructed as a molecular sieve. The structure is composed of molecular arrangements of certain chemical elements, e.g. Na, and encloses large cavities having extensive interior surfaces. With such absorbers it is possible, for example, to remove small residual quantities of water from gases. In switching devices filled with SF6 gas, the binding of water particles is of great significance for the prevention of hydrofluoric acid (HF).

Figure 8:
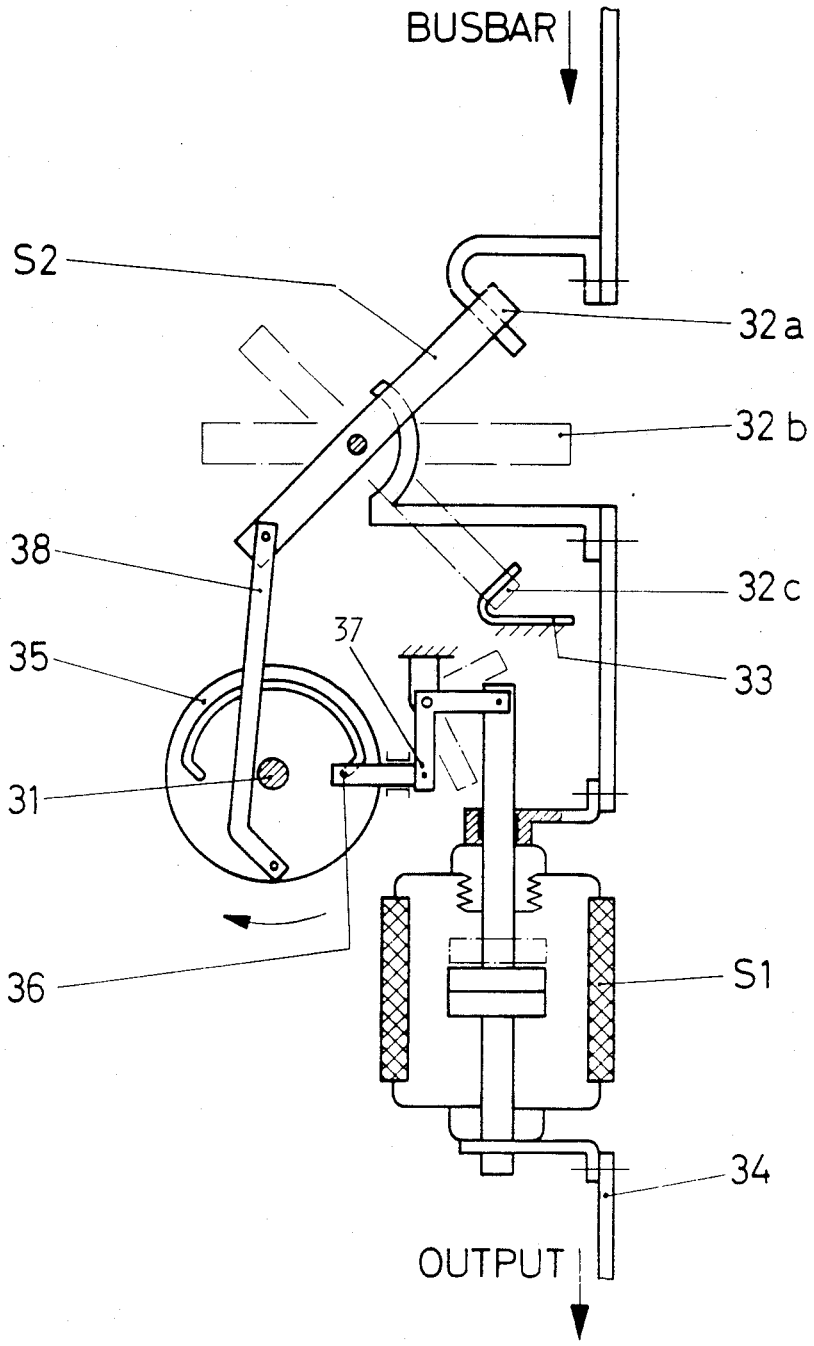
FIG. 8 is a schematic representation of a switch arrangement according to another embodiment of the invention with grounding function.

In a further advantageous embodiment shown in FIG. 8, switch S2 may have, in addition to an operating position 32*a* and an open position 32*b*, a third position 32*c* in which branch 34 is connected, via the closed switch S1, with a ground contact 33 leading to the operating ground of the switching system. The movements of the two switches S1 and S2 may be controlled by a joint energy source (not shown) and via a cam 35 so that, for turn-off according to the invention, switch S1 opens first and, after a delay Δt, switch S2 moves from position 32*a* to position 32*b*, while for a grounding process switch S2 first changes from position 32*b* to position 32*c* and then switch S1 closes. The cam 35 fastened to drive shaft 31 then moves bolt 36 in a groove in such a manner that a rod assembly opens switch S1, via the angle lever 37, on the first part of the rotary movement in the direction of the arrow. Switching rod 38, which is likewise articulated to cam 35, moves from its dead point position and moves switch S2 after a delay Δt into its open position 32*b*. For this switching process, cam 35 performs an angle of rotation of about 90°. The subsequent grounding process takes place over an angle of rotation of a further 90° and, as can easily be seen, proceeds in the reverse sequence.

The present disclosure relates to the subject matter disclosed in German P 36 11 270.4 of Apr. 3, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In an electrical switching device for switching high voltages in a network having a defined rated voltage, the device including a series connection of at least first and second current interrupters having control elements across which a load voltage is distributed, each interrupter operating according to different quenching principles and exhibiting different dielectric behavior immediately after a zero passage of load current to be interrupted, the first interrupter exhibiting a steep rate of rise in its dielectric strength with a maximum dielectric strength value which is a fraction of the defined rated voltage, and the second interrupter having a relatively flat rate of rise in dielectric strength compared to the first interrupter with a maximum dielectric strength value which lies above the maximum dielectric strength value of the first interrupter; the improvement wherein:

said first interrupter comprises a first switch which has an operating voltage that is low relative to a mains voltage of the network and which includes means for interrupting, at relatively low switching voltages without participation of said second interrupter, currents having inductive components; and said second interrupter comprises a second switch having switching contacts and delay means for opening said switching contacts with a time delay of several milliseconds after said first interrupter is opened, for interrupting load currents that are small relative to currents interrupted by said first interrupter;

wherein said series connection of said interrupters interrupts capacitive currents also under grounding conditions with comparatively large recovery voltages and without restriking, with a distribution of voltage across said interrupters when both are open being controlled solely by their own and ground capacitances.

2. Electrical switching device as defined in claim 1, wherein the time delay is equal to an average of the duration of arcs across said first switch for load currents having inductive components.

3. Electrical switching device as defined in claim 1, wherein said first switch is a vacuum load switch and said second switch is a low power load switch operating with a gaseous quenching agent.

4. Electrical switching device as defined in claim 3, wherein said gaseous quenching agent is SF6.

5. Electrical switching device as defined in claim 1, wherein said second interrupter does not have a closed interrupting unit and has an extinguising medium which simultaneously increases outer insulation of said first interrupter.

6. Electrical switching device as defined in claim 5, wherein said second interrupter simultaneously constitutes a disconnecting switch.

7. Electrical switching device as defined in claim 1, and further comprising separate drives for each of said switches, said separate drives being coupled mechanically with one another.

8. Electrical switching device as defined in claim 1, wherein said second switch comprises a pivot arm and said first switch is integrated in said pivot arm and is actuated in dependence on the position of said pivot arm.

9. Electrical switching arrangement comprising a plurality of said switching devices as defined in claim 7, and a common gas tight encapsulation encapsulating said plurality of switching devices.

10. Electrical switching arrangement as defined in claim 9, wherein three-pole units of said switching devices are encapsulated by said encapsulation.

11. Electrical switching arrangement as defined in claim 9, and further including a moisture absorber disposed within said encapsulation.

12. Electrical switching device as defined in claim 1, wherein said second switch includes an insulating fluid as its quenching agent.

13. Electrical switching device as defined in claim 12, wherein said insulating fluid comprises a switch oil.

14. Electrical switching device as defined in claim 1, wherein, said second switch has an operational position, an open position and a position for grounding the network, and further including means for effecting said grounding by successive closings of said first and second switches.

15. Electrical switching device as defined in claim 1, wherein said second interrupter does not have a separate interrupting unit and has an extinguishing medium which simultaneously increases outer insulation of said first interrupter.

16. Electrical switching device as defined in claim 1, wherein said second interrupter does not have at least one of a closed interrupting unit, a separate interrupting unit, and an arc chute and has an extinguishing medium which simultaneously increases outer insulation of said first interrupter.

17. Electrical switching device as defined in claim 1, and further comprising separate drives for each of said switches, said separate drives being coupled electrically with one another.

18. Electrical switching arrangement comprising a plurality of said switching devices as defined in claim 7, and a common liquid tight encapsulation encapsulating said plurality of switching devices.

* * * * *